United States Patent [19]

Itakura

[11] 4,005,887

[45] Feb. 1, 1977

[54] DOOR LOCKING MECHANISM

[75] Inventor: Shoji Itakura, Kariya, Japan

[73] Assignee: Aisin Seiki Kabushiki Kaisha, Japan

[22] Filed: Feb. 3, 1975

[21] Appl. No.: 546,690

[30] Foreign Application Priority Data

Feb. 8, 1974 Japan ..... 49-16539

[52] U.S. Cl. ..... 292/216; 292/DIG. 26; 292/DIG. 27

[51] Int. Cl.² ..... E05B 65/32; E05C 3/06; E05C 3/36

[58] Field of Search ..... 292/216, 280, DIG. 3, 292/DIG. 4, DIG. 23–DIG. 27

[56] References Cited

UNITED STATES PATENTS

| | | | |
|---|---|---|---|
| 2,700,565 | 1/1955 | Smith | 292/DIG. 26 |
| 3,033,602 | 5/1962 | Lee | 292/DIG. 26 |
| 3,394,957 | 7/1968 | Foley | 292/DIG. 26 |
| 3,488,075 | 1/1970 | Barnett et al. | 292/DIG. 27 |
| 3,572,792 | 3/1971 | Foley | 292/216 |
| 3,583,742 | 6/1971 | Kwasiborski | 292/216 |
| 3,596,482 | 8/1971 | Pollack | 292/216 X |
| 3,672,713 | 6/1972 | Pickles | 292/DIG. 26 |
| 3,695,660 | 10/1972 | Fetters | 292/DIG. 26 |

*Primary Examiner*—Paul R. Gilliam
*Assistant Examiner*—Carl F. Pietruszka
*Attorney, Agent, or Firm*—Oblon, Fisher, Spivak, McClelland & Maier

[57] ABSTRACT

A keyless door locking mechanism for an automotive vehicle comprises a latch member engageable with a striker element on the vehicle body during closing of the door, a detent element engageable with the latch member for keeping the same latched when engaged by the striker, a release element having a shoulder being connectable with the detent for releasing engagement of the latch member and the detent in an unlocked position thereof, a locking lever for moving the release element to a locked position to free the connection of the detent and the release element, a keyless locking lever being moveable with the locking lever between the unlocked and locked positions thereof and being further moveable to a keyless locked position, a cancelling lever moveable with the locking lever between the unlocked and locked positions thereof and further moveable to the keyless locked position and being engageable with the detent to return the locking lever moved to its locked position during door opening to its unlocked position upon door closure, but being disengaged with the detent by the keyless locking lever at the locked position thereof to maintain the locking lever so moved to its locked position during door opening to keylessly lock the door lock mechanism upon door closure, and a manually operable inside rod for moving the keyless locking lever to its locked position independently of the locking lever.

5 Claims, 8 Drawing Figures

DOOR LOCKING MECHANISM

BACKGROUND OF THE INVENTION

1. Field of the Invention

The present invention relates generally to door locking mechanisms for motor vehicles and more particularly to an improved keyless locking mechanism of the character described.

2. Description of the Prior Art

Heretofore, keyless locking mechanisms for motor vehicle doors have required two operational steps, first the operation of a locking button on the inside of a vehicle door while the door is open, and then the operation of an outside door handle, in order to lock the door when it is subsequently closed. Further, since the locking operation of a conventional keyless locking mechanism is done by blocking the operation and working of the outside or inside opening handles, the mechanism is subjected to unreasonable forces, and as a result, the mechanism is readily damaged and is also likely to constitute an obstacle to its normal operation. Furthermore, in the conventional keyless locking mechanisms, the operator who mistakenly leaves the key inside the vehicle may accidentally be locked out of the motor vehicle.

SUMMARY OF THE INVENTION

It is therefore a principal object of the present invention to provide an improved keyless locking mechanism wherein a locking button on the inside of the vehicle door is operable, without operating an outside door handle, to cause the door to be locked upon being closed, whereby keyless locking can be achieved by carrying out a one-step operation.

Another object of the present invention is to provide an improved keyless locking mechanism which is capable of preventing an operator from inadvertently locking the door.

Still another object of the present invention is to provide an improved keyless locking mechanism which is capable of satisfactorily achieving the original function thereof without unreasonable forces being applied thereto.

The foregoing and other objects are attained through the provision of a door locking mechanism for a vehicle which comprises a mounting plate secured on the vehicle door, a latch member pivoted on the mounting plate for engaging a striker element secured on the vehicle body during door closure, and a detent member pivoted on the mounting plate for keeping a latched position of the latch member when the latter is brought into engagement with the striker element upon door closure. When the engagement between the latch member and one arm of the detent member is released by connecting a release member with the detent member, the vehicle door is opened by operating an inside or outside door handle. When the connection between the release member and the detent member is free, however, the vehicle door is in a locked state.

A locking member is provided to displace the release member from the original position to a selected position wherein the release member is not connected to the detent member, the locking member being displaced to the selected position by means of an outside key or an inside setting member. The inside setting member may displace the locking member through a keyless locking member. The locking member is operably connected with a cancelling member which is moveable together with the locking member between the original position and the selected position and is connectable with the other arm of the detent member at the selected position, whereby the locking member displaced to the selected position during the door opening is returned back to its original position.

The keyless locking member is further moveable to another selected position independently of the locking member by the setting member. When the keyless locking member is displaced to the other selected position, the cancelling member is also displaced to a position wherein the cancelling member does not connect the other arm of the detent member, whereby the locked state of the locking member moved to the selected position during the door opening is maintained to keylessly lock the door lock mechanism upon door closure.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference numerals designate like or corresponding parts throughout the several views and wherein.

DETAILED DESCRIPTION OF A PREFERRED EMBODIMENT

Figure 1:
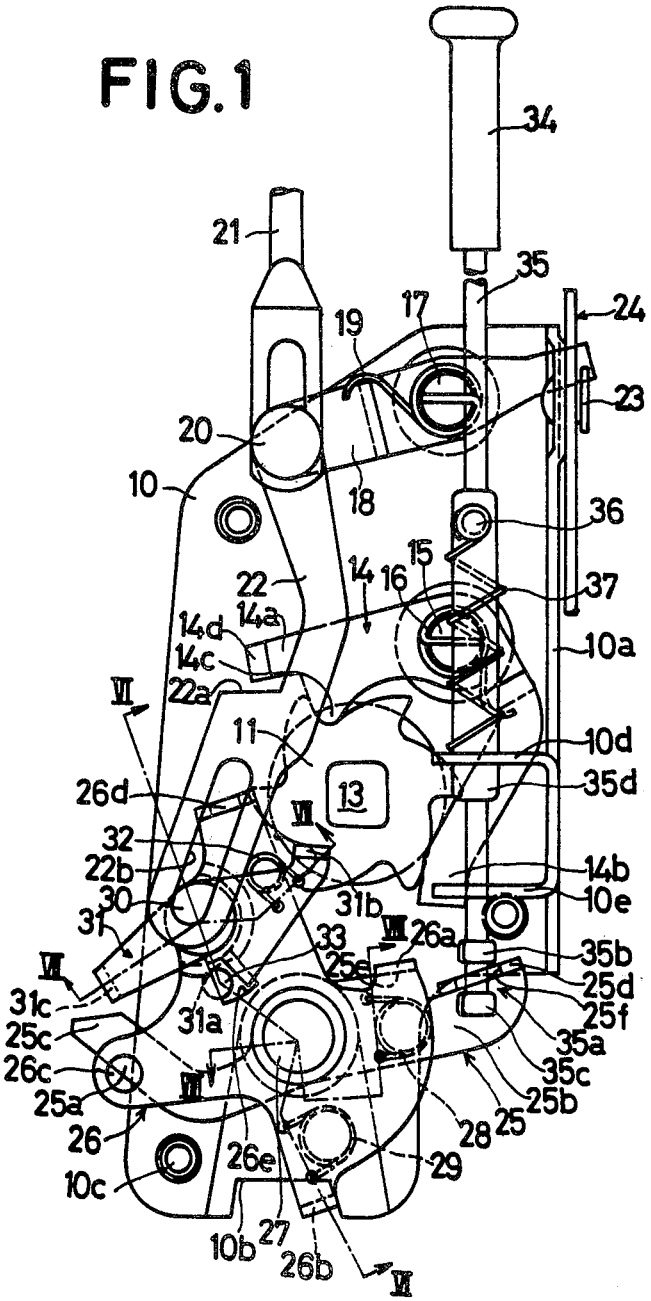
FIG. 1 is an elevational view of one embodiment of a door lock mechanism constructed according to the present invention and kept in its unlocked position.

Referring now to the drawings, the numeral 10 designates a base plate of L-shaped configuration being formed with a side wall 10*a*, a recessed portion 10*b* at the lower end portion thereof and a plurality of bolt holes 10*c*, shown herein as being three in number, for insertion of screw bolts, not shown, for being detachably fixed to the conventional side panel of an automotive vehicle door. A ratchet wheel 11 is fixed to a latch 12 by a rotatable shaft 13 rotatably pivoted on the middle portion of the base plate 10. The latch 12 is formed to cooperate with a conventional striker, not shown, fixed to the vehicle body, when the door is closed.

The numeral 14 designates an L-shaped detent having a leftwardly extending arm 14*a* and a downwardly extending arm 14*b*, as seen in FIG. 1, being pivotally mounted about a pin 15 integral with the base plate 10 and being urged in the counter-clockwise direction by a coil spring 16 disposed between the detent 14 and the pin 15. The leftwardly extending arm 14*a* of the detent 14 is provided with a pawl 14*c* on a downward or lower portion thereof which gears with ratchet teeth of the ratchet wheel 11. Further, the leftward arm 14*a* is provided with an upright flange 14*d* at the left end thereof.

An open lever 18 is pivoted on the base plate 10 by a pin 17 and is urged in the counter-clockwise direction by a coil spring 19 tensioned between the open lever 18 and the pin 17. An outside open rod 21 linked with an outside door handle, not shown, and a coupling lever 22 are pivoted by a pivot pin 20 on one end of the open lever 18. The other end of the open lever 18 is extended into an elongated slot 10*i* formed in the side wall 10*a* of the base plate 10 where it is engageable with one end 24*a* of an L-shaped inside open lever 24 being pivotally supported by a pin 23 on the side wall 10*a*. The other end 24*b* of the inside open lever 24 is linked with an inside open handle, not shown. A keyless locking lever 25, having a leftwardly extending arm 25*a* and a rightwardly extending arm 25*b* and an intermediate locking lever 26 of a cross-shaped configuration are pivoted by a pin 27 on the base plate 10. An overcenter type coil torsion spring 28 is hooked between the keyless locking lever 25 and the intermediate locking lever 26, whereby the keyless locking lever 25 is urged in the counter-clockwise direction and the intermediate lever 26 is urged in the clockwise direction such that a shoulder 25*e* of the rightward arm 25*b* of the keyless locking lever 25 is urged toward a turned down flange 26*a* of the locking lever 26.

The locking lever 26 is formed with a flange 26*b* at the lower end thereof, being received within the recessed portion 10*b* of the base plate 10. Further, the locking lever 26 is formed with an upright flange 26*d* at the upper end thereof, being received within an elongated slot 22*b* provided at the lower portion of the coupling lever 22. The locking lever 26 is further provided with a hole 26*c* at the leftward end thereof, again as viewed in FIG. 1, which is used for coupling with an outside key means, not shown. An overcenter type coil torsion spring 29 is disposed between the locking lever 26 and the base plate 10, the tensioning force of which is not as strong as that of the spring 28.

A cancelling lever 31 is pivoted by a pin 30 on the locking lever 26. The cancelling lever 31 is formed with turning down flanges 31*a* and 31*c* at the lower and leftward ends thereof, respectively, and an upright flange 31*b* at the rightward end thereof. The flange 31*b* is in a locus which is described by the turning of the arm 14*b* of the detent 14 around the pin 15 when the cancelling lever 31 is in its locked position shown in a solid line in FIG. 3, wherein said locking lever 26 is in its locked position shown in FIG. 3, and is out of the locus when the lever 31 is in its unlocked position, shown in FIG. 1 wherein the locking lever 26 is in its unlocked position shown in FIG. 1. The flange 31*c* is engaged with a left end 25*c* of the keyless locking lever 25 when the locking lever 26 and the cancelling lever 31 are in the locked position, shown in a solid line in FIG. 3, by turning the lever 25 in the clockwise direction, whereby the flange 31*c* is moved rotatively about the pin 30 in the clockwise direction, such that the cancelling lever 31 is moved rotatively into its keyless locked position, shown in a dotted line in FIG. 3, and the flange 31*b* is out of the locus of the arm 14*b* of the detent 14.

The flange 31*a* is received within a slot 26*e* of the locking lever 26. An overcenter type coil torsion spring 32 is disposed between the locking lever 26 and the cancelling lever 31. A stopper pin 33 is secured to the base plate 10 in a position where the flange 31*a* of the cancelling lever 31 faces the stopper pin 33 when the cancelling lever 31 is in a position shown in FIG. 3 and the locking lever 26 is in a position shown in FIG. 1.

The coupling lever 22 is provided with a horizontal surface 22*a* at the intermediate portion thereof, which is engageable with the flange 14*d* of the detent 14 to lift up the flange 14*d* by turning the open lever 18 about the pin 17 in the clockwise direction when the locking lever 26 is in its unlocked position shown in FIG. 1.

The keyless locking lever 25 is provided with an upright flange 25*d* at the upper end of the right arm 25*b* thereof. The flange 25*d* is provided with a slot 25*f* at the intermediate portion thereof, through which a lower end portion 35*a* of a round-shaped rod 35 connected with a push button 34 passes. The lower end portion 35*a* has two enlarged portions, an upper enlarged portion 35*b* and a lower portion 35*c*, formed at opposite sides of the slot 25*f*, the diameters of which enlarged portions 35*b* and 35*c* are larger than that of the slot 25*f*. A middle portion 35*d* of the rod 35 has a flattened or a plate-like shape.

Figure 4:
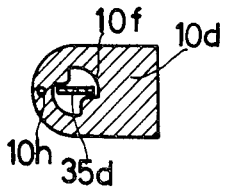
FIG. 4 is a sectional view of a part of the mechanism taken along the plane of line IV—IV in FIG. 3.
Figure 5:
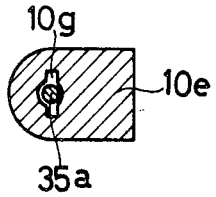
FIG. 5 is a sectional view of a part of the mechanism taken along the plane of line V—V in FIG. 3.
Figure 6:
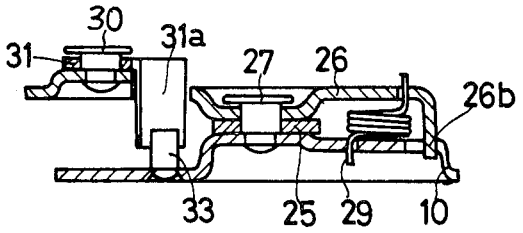
FIG. 6 is a sectional view of a part of the mechanism taken along the plane of line VI—VI of FIG. 1.
Figure 7:
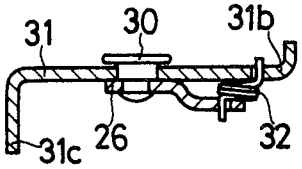
FIG. 7 is a sectional view of a part of the mechanism taken along the plane of line VII—VII in FIG. 1.
Figure 8:
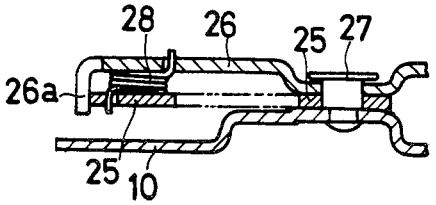
FIG. 8 is a sectional view of a part of the mechanism taken along the plane of line VIII—VIII in FIG. 1.

The side wall 10*a* is formed with a first supporting arm 10*d* and a second supporting arm 10*e* at the lower portion thereof for supporting the rod 35. The first supporting arm 10*d* is provided with a slot 10*f*, through which the middle portion 35*d* of the rod 35 passes. The shape of the slot 10*f* is spool-like to make it possiblefor the middle portion 35*d* of the rod 35 to move rotatively through 90° therewithin, as shown in FIG. 4. The second supporting arm 10*e* is provided with an elongated slot 10*g* having a central portion like an enlarged circle, as shown in FIG. 5, through which the round rod 35 is able to pass and through which the middle portion 35*d* of the plate-like configuration is also able to pass when the rod 35 is turned through 90°.

A coil spring 37 is coiled around the middle portion 35*d* of the rod 35, one end of which is hooked on a pin 36 secured to the upper portion of the middle portion 35*d* of the rod 35 and the other end of which is hooked in a slot 10*h* shown in FIG. 4, provided in the first supporting arm 10*d* of the side wall 10*a*. The tensioning force of the spring 37 is not as strong as that of the overcenter type coil torsion spring 29.

Figure 2:
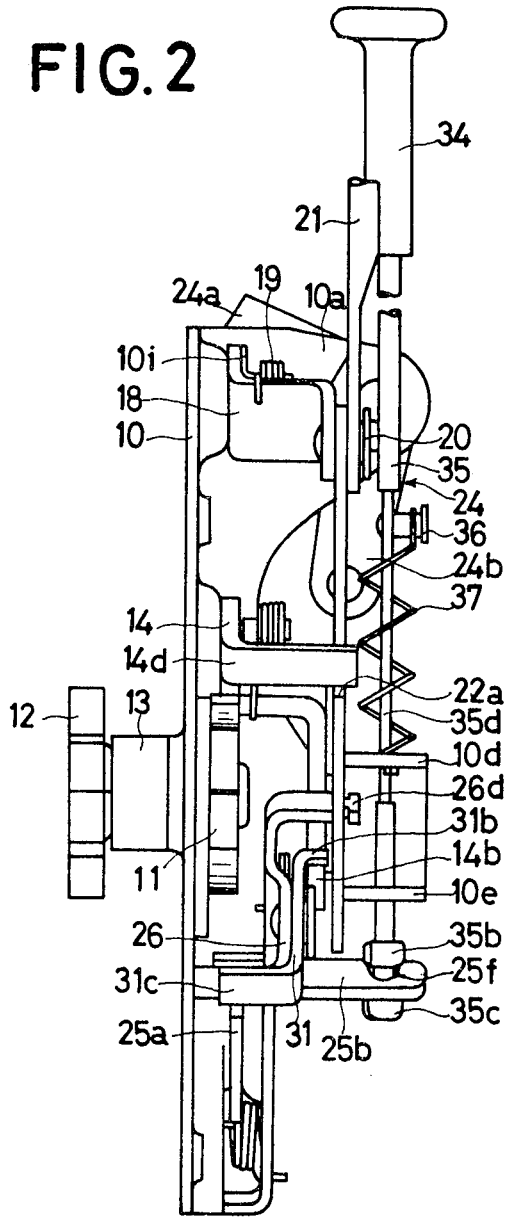
FIG. 2 is a side elevational view of the mechanism of FIG. 1, being viewed from the left hand side thereof.

In describing the operation of the present device, FIG. 1 shows the lock in its released or unlocked state. When the opening lever 18 is moved rotatively about the pin 17 in the clockwise direction against the normal biasing force of the coil spring 19 by lifting up the outside open rod 21 by means of operating the outside door handle, not shown, or by turning the inside opening lever 24 about the pin 23 in the counter-clockwise direction, as seen in FIG. 2, by means of operating the inside door handle, not shown, the coupling lever 22 moves slidably upwardly along the upright flange 26*d* of the locking lever 26 by the elongated slot 22*b* therein, whereby the surface 22*a* of the coupling lever 22 is engaged with the flange 14*d* of the detent 14 thereby to move the detent rotatively about the pin 15 in the clockwise direction, as shown in FIG. 1, such that the gearing of the pawl 14*c* of the detent 14 and the teeth of the ratchet wheel 11 is released, and the ratchet wheel 11 and the latch 12 are in turn released, and thus the door may be opened.

Figure 3:
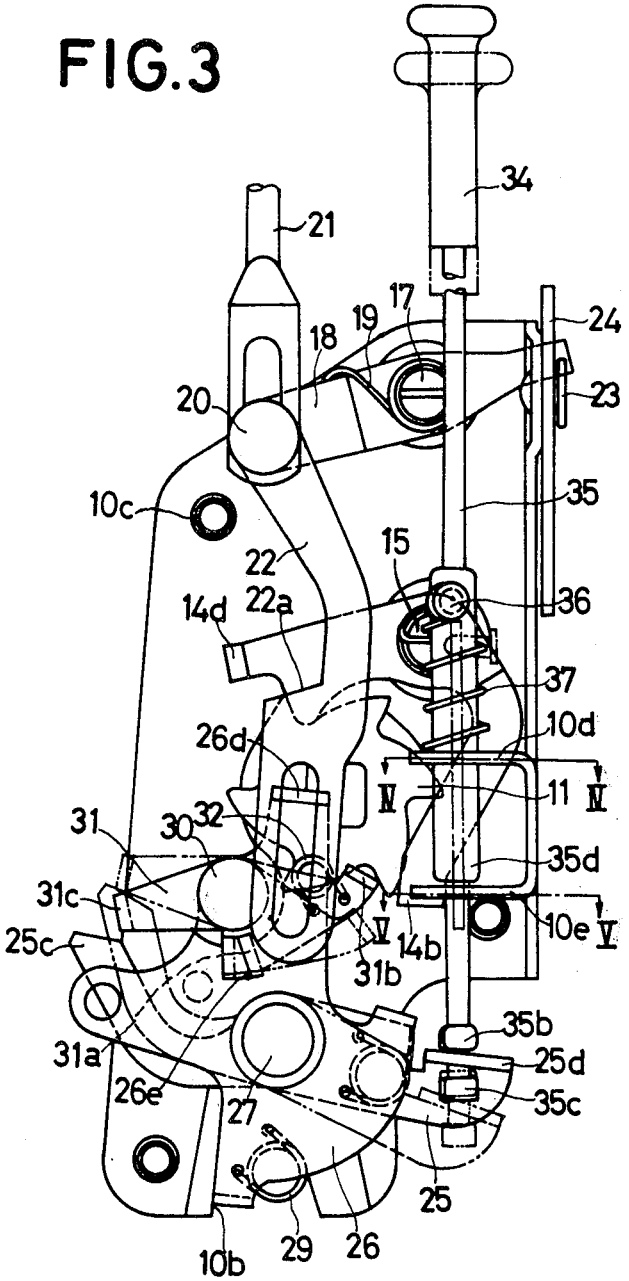
FIG. 3 is a view of the mechanism similar to that shown in FIG. 1, but with the mechanism being shown in its locked position.

A locking operation is done by displacing the locking lever 26 from the state wherein the door is closed and in its unlocked position, as shown in FIG. 1, to the position shown in FIG. 3, by means of an outside key means of the door or the inside push button 34. When the locking operation is to be performed by means of the inside push button 34, it becomes effective simply by pushing the push button 34 downwardly. The downward movement of the push button 34 is limited at the position where the lower end of the middle portion 35*d* of the rod is in contact with the upper face of the second supporting arm 10*e* by the phase difference of 90° existing between the longitudinal direction of the spool-like shaped slot 10*f* and the plane of the middle portion 35*d* of the rod 35, as shown in FIG. 5. The upper enlarged portion 35*b* pushes the flange 25*d* of the keyless locking lever 25 downwardly according to this downward movement of the push button 34, whereby the lever 25 is moved rotatively about the pin 27 in the clockwise direction.

This rotative movement of the keyless locking lever 25 is transmitted through the overcenter type coil torsion spring 28 to the locking lever 26, and since the tensioning force of the spring 28 is stronger than that of the over-center type coil torsion spring 29, the locking lever 26 is also moved rotatively about the pin 27 in the clockwise direction. The rotative movement in the clockwise direction of the locking lever 26 is limited by the engagement of the stopper flange 26*b* of the lever 26 and the recessed portion 10*b* of the base plate 10, and then the lever 26 is kept at the position shown in FIG. 3 by the tensioning force of the spring 29.

The upright flange 26*d* of the locking lever 26 being received within the elongated slot 22*b* of the coupling lever 22 is moved rotatively about the pin 27 in the clockwise direction according to the displacement of the lever 26 from the position shown in FIG. 1 to the position shown in FIG. 3, whereby the coupling lever 22 is also moved about the pivot pin 20 in the counter-clockwise direction, as shown in FIG. 3, whereby the surface 22*a* of the coupling lever 22 does not contact with the upright flange 14*d* of the detent 14, even if the opening lever 18 is thereafter rotated by means of the outside door handle or the inside door handle. Therefore, with such rotation of the outside or inside door handles, the engagement of the pawl 14*c* of the detent 14 and the teeth of the ratchet wheel 11 is not released, and accordingly the door lock remains in its locked condition, which is shown in FIG. 3.

In the operation as hereinbefore described, the cancelling lever 31 pivoted by the pin 30 on the locking lever 26 is also moved rotatively about the pin 30 in the clockwise direction at the same angle as the lever 26 is moved rotatively by the tensioning force of the over-center type coil torsion spring 32, whereby the flange 31*b* of the cancelling lever 31 is in the locus which is described by turning of the downward arm 14*b* of the detent 14. Therefore, when the door is to be closed from the position shown in FIG. 3, wherein the door is open and the lock in its locked state, the ratchet wheel 11 moves rotatively in the counter-clockwise direction according to the rotative movement of the latch 12 being engaged with the striker, whereby the detent 14 is moved rotatively about the pin 15 in the clockwise direction instantaneously by means of the teeth of the ratchet wheel 11 such that the flange 31*b* of the cancelling lever 31 is turned in the counter-clockwise direction by the movement of the downward arm 14*b* of the detent 14. This movement of the cancelling lever 31 moves the locking lever 26 rotatively about the pin 27 in the counter-clockwise direction, since the flange 31*a* of the cancelling lever 31 is engaged with the right end of the slot 26*e* of the lever 26 and the pin 30 by which the cancelling lever 31 is pivoted is integral with the locking lever 26. Thus, the locking lever 26 and the keyless locking lever 25 are urged to return to the unlocked position shown in FIG. 1, effecting a self-cancelling operation, whereby the door may be reopened by operating of the outside door handle or the inside door handle after the closure of the door.

The push button 34 is further pushed down from the position shown in FIG. 3, wherein the door is open and the lock in its locked position, by turning the push button 34 through about 90°, such that the longitudinal direction of the flattened middle portion 35*d* of the rod 35 being connected with the push button 34 coincides with the longitudinal direction of the slot 10*g* of the second supporting arm 10*e*. Further downward movement of the rod 35 then causes the flange 25*d* of the locking lever 25 to be moved about the pin 27 in the clockwise direction, to the position which is shown in a broken line in FIG. 3, by the upper enlarged portion 35*b*. According to the rotative movement of the keyless locking lever 25, the flange 31*c* of the cancelling lever 31 is moved rotatively around the pin 30 in the clockwise direction by the left end 25*c* of the lever 25 against the tensioning force of the spring 32, and then the cancelling lever 31 is held at the position shown by the broken line in FIG. 3 by the tensioning force of the spring 32 in which the flange 31*b* of the cancelling lever 31 is out of the locus of the arm 14*b* of the detent 14. Thus, even if the door is closed after the displacement of the keyless locking lever 25 to the position shown by the dotted line in FIG. 3, the locking state is kept as hereinbefore described, whereby keyless locking operation is possible independently of the conventional operation by means of the outside open handle.

In the keyless locking operation, when the pushing action on the push button 34 connected with the rod 35 is released, after the displacement of the rod 35 to the position shown by the dotted line in FIG. 3, the push button 34 is turned back about 90° due to the returning force of the spring 37, and the keyless locking lever 25 and the push button 34 are further returned to the position shown by the solid line in FIG. 3, wherein the lock is in its locked position, but since the cancelling lever 31 is in the keyless locking position shown by the dotted line in FIG. 3, the keyless locking operation is possible by closing the door in this state. If the locking lever 26 is then returned back to its unlocked position, shown in FIG. 1, by means of the outside key means or push button when the cancelling lever is in the keyless locking position, the flange 31*a* of the cancelling lever 31 is engaged with the stopper 33, whereby the cancelling lever 31 is moved rotatively about the pin 30 in the counter-clockwise direction to thereby return to the position shown in FIG. 1.

In this operation, the lower enlarged portion 35*c* pulls up the flange 25*d* of the keyless locking lever 25 by pulling up the push button 34 thereby to make the intermediate locking lever 26 move rotatively in the counter-clockwise direction to the unlocked position.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A door locking mechanism for a vehicle comprising:

a latch member;

a detent operatively engageable with said latch member for maintaining said latch in a latched position;

a release member operatively engaged with said detent at an unlocked position during an unlocked operation of said mechanism for releasing said engagement of said detent with said latch member, and operatively disengaged from said detent at a locked position during a locked operation of said mechanism for preventing release of said detent from said latch member;

inside and outside opening means respectively connected to said release member for controlling the engagement of said release member with said detent;

a locking lever operably connected to said release member and shiftable between an unlocked position thereof and a locked position thereof for shifting said release member between said unlocked and locked positions thereof;

a cancelling lever pivotably mounted on said locking lever and shiftable between an unlocked position thereof wherein said locking lever is in said unlocked position thereof, and a keyless locked position thereof wherein said locking lever is in said locked position thereof, and through a locked position thereof wherein said locking lever is in said locked position thereof, said cancelling lever being engageable with said detent only during said locked position thereof so as to thereby return said locking lever to said unlocked position thereof;

first means for shifting said cancelling lever between said unlocked and locked positions thereof together with said locking lever, and for permitting said cancelling lever to be shifted between said locked and keyless locked positions thereof independently of said locking lever;

a keyless locking lever shiftable between an unlocked position thereof, wherein said locking lever is in said unlocked position thereof, and a keyless locked position thereof, wherein said locking lever is in said locked position thereof, and through a locked position thereof, wherein said locking lever is in said locked position thereof;

second means for shifting said locking lever between said unlocked and locked positions thereof together with said keyless locking lever and for maintaining said locking lever at said locked position thereof when said keyless locking lever is shifted to said keyless locked position thereof for shifting said cancelling lever to said keyless locked position thereof; and rod means connected to said keyless locking lever and movable between first, second and third positions thereof for shifting said keyless locking lever between said unlocked, locked and keyless locked positions thereof, respectively.

2. A door locking mechanism as set forth in claim 1, further comprising:

stopper means for stopping the movement of said rod means at said second position thereof by engaging stopper means of said rod means, said stopper means permitting further movement of said rod means by facilitating the engagement of said stopper means with said stopper means of said rod means as a result of turning said rod means through a predetermined angle, whereby said rod means is able to be shifted to said third position thereof.

3. A door locking mechanism as set forth in claim 2, wherein:

said stopper means of said rod means is a projection radially projecting from the outer periphery thereof.

4. A door locking mechanism as set forth in claim 3, wherein:

said stopper means is formed with an elongated slot having a shape which corresponds to the cross-sectional shape of a portion of said rod means including said projection.

5. A door locking mechanism as set forth in claim 4, further comprising:

means for normally maintaining the phase difference between said projection of said rod means and said slot of said stopper means and through said predetermined angle.

* * * * *